US005903286A

United States Patent [19]

Takahashi

[11] Patent Number: 5,903,286

[45] Date of Patent: May 11, 1999

[54] METHOD FOR EJECTING INK DROPLETS FROM A NOZZLE IN A FILL-BEFORE-FIRE MODE

[75] Inventor: Yoshikazu Takahashi, Nagoya, Japan

[73] Assignee: Brother Kogyo Kabushiki Kaisha, Nagoya, Japan

[21] Appl. No.: 08/680,690

[22] Filed: Jul. 18, 1996

[30] Foreign Application Priority Data

Jul. 18, 1995 [JP] Japan ..... 7-181646
Jul. 20, 1995 [JP] Japan ..... 7-184306

[51] Int. Cl.[6] ..... B41J 2/045

[52] U.S. Cl. ..... 347/11; 347/68

[58] Field of Search ..... 347/11, 10, 68

[56] References Cited

U.S. PATENT DOCUMENTS

| | | | |
|---|---|---|---|
| 3,946,398 | 3/1976 | Kyser et al. | 347/70 |
| 4,723,129 | 2/1988 | Endo et al. | 347/56 |
| 4,743,924 | 5/1988 | Scardovi | 347/10 |
| 4,879,568 | 11/1989 | Bartky et al. | 347/69 |
| 4,972,211 | 11/1990 | Aoki | 347/11 |

*Primary Examiner*—Joseph Hartary
*Assistant Examiner*—Craig A. Hallacher
*Attorney, Agent, or Firm*—Oliff & Berridge, PLC

[57] ABSTRACT

A driving method for driving an ink ejection device operated in shear mode. In order that the ink ejection speed does not vary depending on the driving frequency, a first pulse signal and a second pulse signal are sequentially applied to the electrode of an ink channel. The first pulse signal is for ejecting an ink droplet from the corresponding nozzle of the ink channel, and the second pulse signal is for canceling pressure fluctuations remaining in the ink after ejection of ink. The second pulse signal has a voltage level equal to that of the first pulse signal. At the rising edge of the first pulse signal, the volume of the ink channel is increased from a natural volume to an increased volume. As a result, a pressure wave is generated in the ink filling the ink channel. At the falling edge of the first pulse signal, the volume of the ink chamber reverts to the natural volume, thereby ejecting an ink droplet from the nozzle. Thereafter, the second signal is applied to cancel out the residual pressure fluctuations. In the present invention, the sequential timings of the first and second pulse signals including the durations of the first and second pulse signals are specifically defined based on evaluation of experimental results.

15 Claims, 14 Drawing Sheets t = t0 = 0 t = t1 = L/a t = t2 = 2L/a t = t3 = 3L/a t = t4 = 4L/a t = t5 = 5L/a t = t6 = 6L/a t = t0 = 0 t = t1 = L/a t = t2 = 2L/a t = t3 = 3L/a t = t4 = 4L/a t = t5 = 5L/a t = t6 = 6L/a t = t7 = 7L/a

FIG. 12 (a)

| Wb (xT) \ Td (xT) | 2.0 | 2.25 | 2.5 | 2.75 | 3.0 |
|---|---|---|---|---|---|
| 0.3 | × | ○ | ○ | ○ | × |
| 0.5 | △ | ○ | ◎ | ○ | △ |
| 0.7 | × | ○ | ○ | ○ | × |
| 1.0 | × | △ | ○ | △ | × |
| 1.3 | △ | ○ | ◎ | ○ | △ |
| 1.5 | △ | ○ | ◎ | ○ | △ |
| 1.7 | △ | ○ | ◎ | ○ | △ |
| 2.0 | × | △ | ○ | △ | × |

◎ VELOCITY FLUCTUATION : LESS THAN 1.0 m/s

○ VELOCITY FLUCTUATION : 1.0 ~ 2.0 m/s

△ VELOCITY FLUCTUATION : 2.0 ~ 3.0 m/s

× EJECTION DISABLED

FIG. 12 (b)

| Wb (xT) \ Td (xT) | 3.1 | 3.2 | 3.25 | 3.3 | 3.4 | 3.5 | 3.6 | 3.7 | 3.75 | 3.8 | 3.9 |
|---|---|---|---|---|---|---|---|---|---|---|---|
| 0.3 | × | △ | ○ | ○ | ○ | ○ | ○ | ○ | △ | × | × |
| 0.5 | × | △ | ○ | ◎ | ◎ | ◎ | ◎ | ○ | △ | × | × |
| 0.7 | × | △ | ○ | ○ | ○ | ○ | ○ | ○ | △ | × | × |
| 1.0 | × | × | × | × | × | × | × | × | × | × | × |
| 1.3 | × | △ | ○ | ○ | ○ | ○ | ○ | ○ | △ | × | × |
| 1.5 | × | △ | ○ | ◎ | ◎ | ◎ | ◎ | ○ | △ | × | × |
| 1.7 | × | △ | ○ | ○ | ○ | ○ | ○ | ○ | △ | × | × |
| 2.0 | × | × | × | × | × | △ | × | × | × | × | × |

◎ VELOCITY FLUCTUATION : LESS THAN 1.0 m/s
○ VELOCITY FLUCTUATION : 1.0 ~ 2.0 m/s
△ VELOCITY FLUCTUATION : 2.0 ~ 3.0 m/s
× EJECTION DISABLED

METHOD FOR EJECTING INK DROPLETS FROM A NOZZLE IN A FILL-BEFORE-FIRE MODE

BACKGROUND OF THE INVENTION

1. Field of the Invention

The present invention relates to a driving method for an ink ejection device.

2. Description of Related Art

Of non-impact type printing devices which have recently taken the place of conventional impact type printing devices and have greatly propagated in the market, ink-ejecting type printing devices have been known as being operated on the simplest principle and as being effectively used to easily perform multi-gradation and coloration. Of these devices, a drop-on-demand type for ejecting only ink droplets which are used for printing has rapidly propagated because of its excellent ejection efficiency and low running cost.

The drop-on-demand types are representatively known as a Kyser type, as disclosed in U.S. Pat. No. 3,946,398, or as a thermal ejecting type, as disclosed in U.S. Pat. No. 4,723,129. The former, or Kyser type, is difficult to design in a compact size. The latter, the thermal ejecting type requires the ink to have a heat-resistance property because the ink is heated at a high temperature. Accordingly, these devices have significant problems.

A shear mode type printer, as disclosed in U.S. Pat. No. 4,879,568, has been proposed as a new type to simultaneously solve the above disadvantages.

As shown in FIGS. 1(*a*) and 1(*b*), the shear mode type of ink ejection device 600 comprises a bottom wall 601, a ceiling wall 602 and a shear mode actuator wall 603 therebetween. The actuator wall 603 comprises a lower wall 607 which is adhesively attached to the bottom wall 601. An upper wall 605 is adhesively attached to the ceiling wall 602 and polarized in the direction indicated by an arrow 609. A pair of actuator walls 603 thus formed forms an ink channel 613 therebetween. A space 615 which is narrower than the ink channel 613 is also formed between neighboring pairs of actuator walls 603 in an alternating relationship to the ink channels 613.

A nozzle plate 617, having nozzles 618 formed therein, is fixedly secured to one end of each ink channel 613, and electrodes 619 and 621 are provided as metallized layers on both side surface of each actuator wall 603. Each of the electrodes 619,621 is covered by an insulating layer (not shown) to insulate it from the ink. The electrodes 621 which face the space 615 are connected to ground 623, and the electrodes 619 which are provided in the ink channel 613 are connected to a silicon chip which forms an actuator driving circuit 625.

Next, a manufacturing method for the ink ejection device 600 as described above will be described. First, a piezoelectric ceramic layer, which is polarized in a direction as indicated by an arrow 611, is adhesively attached to the bottom wall 601 and a piezoelectric ceramic layer, which is polarized in a direction as indicated by an arrow 609, is adhesively attached to the ceiling wall 602. The thickness of each piezoelectric ceramic layer is equal to the height of each of the lower walls 607 and the upper walls 605. Subsequently, parallel grooves are formed on the piezoelectric ceramic layers by a diamond cutting disc or the like to form the lower walls 607 and the upper walls 605. Further, the electrodes 619 are formed on the side surface of the lower walls 607 by a vacuum-deposition method, and the insulating layer, as described above is provided onto the electrodes 619. Likewise, the electrodes 621 are provided on the side surfaces of the upper walls 605 and the insulating layer is further provided on the electrodes 621.

The vertex portions of the upper walls 605 and the lower walls 607 are adhesively attached to one another to form the ink channels 613 and the spaces 615. Subsequently, the nozzle plate 617, having the nozzles 618 formed therein, is adhesively attached to one end of the ink channels 613 and the spaces 615 so that the nozzles 618 face the ink channels 613. The other end of the ink channels 613 and the spaces 615 is connected to the actuator driving circuit 625 and the ground 623.

A voltage is applied to the electrodes 619, 921 of each ink channel 613 from the actuator driving circuit 625, whereby each actuator wall 603 suffers a piezoelectric shear mode deflection in such a direction that the volume of each ink channel 613 increases. For example, as shown in FIG. 2, when a voltage V is applied to the electrodes of the ink channel 613*c*, an electric field is generated in the actuator wall 603*e* in the direction indicated by arrows 627 and an electric field is generated in the actuator wall 603*f* in the direction indicated by arrows 629. Because the electric field directions 627, 629 are at right angles to the polarization direction 609, 611, the actuator walls 603*d*, 603*e* deform outward to increase the volume of the ink channel 613*c* by the piezoelectric shear effect, resulting in a decrease in the pressure in the ink chamber 613*c*, including near the nozzle 618*c*. The negative pressure is maintained for a duration of time T corresponding to a duration of time during which time pressure wave propagates one way of the ink channel 613. During the time duration T, ink is supplied from a manifold (not shown). At this time, the meniscus 24 retracts toward the interior of the ink channel 613*c* as shown in FIG. 3(*b*). The duration of time T is necessary for a pressure wave to propagate across the lengthwise direction of the ink channel.

The duration of time T is given by L/a wherein L is the length of the ink channel 613 and a is the speed of sound through the ink filling channel 613. Theories on pressure wave propagation teach that at the moment the duration of time L/a elapses after the rising edge of voltage, the pressure in the ink channel 613 inverts to a positive pressure. The voltage applied to the electrode 619*c* of the ink channel 613*c* is returned to 0 V in synchronization with the timing when the pressure in the ink channel 613 is inverted so that the actuator walls 603*e*, 603*f* revert to their initial shape shown in FIG. 1(*a*). The pressure generated when the actuator walls 603*e*, 603*f* return to their initial shape is added to the inverted positive pressure so that a relatively high pressure is generated in the ink channel 613*c*. This relatively high pressure ejects an ink droplet 26 from the nozzle 618*c* as shown in FIG. 3(*c*) through 3(*g*).

However, a portion of the relatively high pressure is consumed in pushing the meniscus 24 toward the aperture of the nozzle 618*c* to return the meniscus 24 to the shape shown in FIG. 3(*a*). This wasted portion of the pressure does not contribute to ejection of the ink droplet. The remaining pressure may be insufficient to eject a sufficiently large ink droplet, thereby resulting in poor print quality.

A co-pending U.S. patent application Ser. No. 08/393,391 filed Feb. 23, 1995 by Qiming Zhang and assigned to the same assignee of the present application proposes increasing volume of the ink channel to generate pressure wave in the ink channel, and upon expiration of a predetermined period of time defined as approximately the time interval multiplied by an odd number equal to or greater than three, decreasing volume of the ink channel. By such a driving control, a part of the volume of ink in the ink channel can be expelled outwardly of the nozzle prior to ejecting the ink droplet and hence a relatively large volume of ink droplet can be ejected.

If no succeeding pulses are applied to the electrodes 619*e*, 619*f* of the ink channel 613*c* after ink ejection, the pressure in the ink channel 613*c* continues fluctuating for a while at a cycle of 2T. These are the residual pressure fluctuations. When the frequency of the voltage pulses is changed, the ink ejection speed changes due to the residual pressure variations, so that the ink droplet arrival point is shifted and thus print quality is degraded. At worst, the printing cannot be performed.

Japanese Patent Laid-Open Publication (Kokai) No. SHO-62-299343 describes applying a cancel pulse subsequent to application of a print pulse for ejection of ink so that the residual pressure fluctuations in the ink chambers are decreased. After a predetermined duration of time elapses following ejection of ink, a cancel pulse is applied for generating a pressure wave with a phase that is exactly opposite to the phase of residual pressure fluctuations in the ink chamber. For example, as shown in FIG. 5(*a*), a cancel pulse D with a width 3T and a phase that is opposite to the phase of the ejection pulse is applied to the electrode 619 of the ink channel 613 after expiration of a time T following the falling edge of the ejection pulse C. The voltage level of the cancel pulse D is determined to just cancel out the residual pressure fluctuations depending on the amplitude of the fluctuations, e.g., 0.6 times as large as the amplitude of the ejection pulse. By application of the cancel pulse, the actuator wall 603 deforms in the direction opposite from the direction it deformed for ejecting ink. A pressure wave with phase that is opposite the phase of the residual pressure fluctuations is applied to cancel out the residual pressure fluctuations. Application of the cancel pulse eliminates the fluctuations of the ink ejection speed when the frequency of the voltage pulses is changed. As a result, an excellent print quality can be obtained.

The similar advantages can be obtained when a cancel pulse D with a width T and a phase that is opposite the phase of the ejection pulse is applied to the electrode 619 after expiration of time T following the falling edge of the ejection pulse C as shown in FIG. 5(*b*).

Next, a drive circuitry for cancelling residual pressure fluctuations will be described. The output signals X, Y, and Z shown in FIG. 7 are for applying voltages V, 0, and −0.6 V respectively to the electrode 619 in the ink channel 613. When the output signal X is at a high level, voltage pulses for ejecting ink are generated (pulses C shown in FIG. 5(*a*)). When the output signal Z is at a high level, a voltage pulse for causing cancellation of pressure fluctuations is generated (pulse D in FIG. 5(*a*)). In all other circumstances, the output signal Y is at a high level so that 0 voltage is output. Capacitors 91 are formed from the actuator wall 603 of the ink channel 613 and the electrodes 615, 619 formed to the both sides of the actuation wall 603.

The drive circuitry is formed from the three blocks surrounded by broken lines. Each block includes an injection charge circuit 82, a discharge circuit 84, and a cancellation pressure generation circuit 86. A high level input signal X renders the transistor Tc conductive so that a positive voltage V from the positive power source 87 is applied to the electrode E of the capacitor 91 via a resistor R12. A high level input signal Y renders the transistor Tg conductive so that electrode E of the capacitor 91 is grounded via the resistor R12. A high level input signal Z renders the transistor Ts conductive so that a negative voltage −0.6 V from a negative power source 88 is applied to the capacitor 91 via the resistor R12.

The residual pressure variations can also be canceled out by applying a cancel pulse E as shown in FIGS. 7(*a*) and 7(*b*). The cancel pulse E is in phase with the ejection pulse C and has a width T and a voltage level determined dependent on the amplitude of the residual pressure fluctuation (for example, 0.5 times as large as the voltage level of the ejection pulse). The cancel pulse E is applied after expiration of time 2T following the falling edge of the ejection pulse C. A driving circuitry for achieving such a cancellation does not require the negative power source 88 as shown in FIG. 6. However, in addition to the positive power source 87 for generating the voltage V, another positive power source for generating a voltage 0.5 V needs to be provided, and these two positive power sources are switched over so as to be selectively used.

According to the driving methods as described, the residual pressure fluctuations are canceled after the pressure wave generated by the application of the ejection pulse C, that is a positive voltage V, propagates one reciprocal way or one and a half of the reciprocal way through the ink channel 613. Therefore, either a cancel pulse D with a negative voltage or a cancel pulse with a positive voltage but differing in the voltage level needs to be applied. This requires a combination of a positive power source and a negative power source or a combination of two positive power sources supplying different voltage levels. The configuration of the driving circuitry is thus complicated and the manufacture thereof is costly.

SUMMARY OF THE INVENTION

In view of the foregoing, it is an object of the present invention to provide a driving method for an ink ejection device capable of producing an ink droplet with a volume sufficient for printing.

Another object of the present invention is to provide a driving method for an ink ejection device using a single power source, wherein variation in the ink ejection speed can be eliminated when the frequency of the voltage pulses is changed.

Still another object of the present invention is to provide a driving method for a low-cost ink ejection device wherein an excellent print quality can be obtained.

An ink ejection device to which the present invention is applied includes wall defining an ink channel, a nozzle plate, an actuator, and control means. The ink channel has a volume filled with ink. The length of the ink channel is defined by two ends opposite to each other. The nozzle plate is formed with a nozzle and attached to one end of the ink channel. The actuator changes the volume of the ink channel and is in the form of a wall defining the ink channel. At least a portion of the actuator is formed from a piezo-electric material. The control means is operable in association with a single power source and is provided for applying pulse signals to the actuator.

A method of driving the ink ejection device according to one aspect of the present invention includes the steps of (a) applying a first pulse signal to the actuator at a first timing To so that the volume of the ink channel is increased from a natural volume to an increased volume, the first pulse signal having a voltage level, wherein a pressure wave is generated in the ink filling the ink channel, a time duration T being required for the pressure wave to propagate one end to the other in a lengthwise direction of the ink channel; (b) stopping the application of the first pulse signal to the actuator at a second timing Tp after expiration of a predetermined duration of time given by multiplying an odd number equal to or greater than three to the time duration T so that the volume of the ink chamber reverts to the natural volume, thereby ejecting an ink droplet from the nozzle, a duration of the first pulse signal being defined by a duration of time from the first timing To to the second timing Tp: (c) applying a second pulse signal to the actuator so that pressure fluctuations remaining in the ink are canceled out, the second pulse signal having a voltage level equal to the voltage level of the first pulse signal; and (d) stopping the application of the second pulse signal to the actuator at a fourth timing Te, a duration of the second pulse signal being defined by a duration of time from the third timing Ts to the fourth timing Te and differing from the duration of the first pulse signal, wherein a midpoint timing Tm between the third timing Ts and the fourth timing Te occurs after 2.25T to 2.75T from the second timing Tp.

The duration of the second pulse signal is in a range from 0.3T to 2.0T. Preferably, the duration of the second pulse signal is in a range from 0.5T to 0.7T or in a range from 1.3T to 1.7T. More preferably, the duration of the second pulse signal is 1.5T.

It is preferable that the midpoint timing Tm occur after 2.5T from the second timing Tp.

According to another aspect of the present invention, there is provided a method of driving the ink ejection device including the steps of (a) applying a first pulse signal to the actuator at a first timing To so that the volume of the ink channel is increased from a natural volume to an increased volume, the first pulse signal having a voltage level, wherein a pressure wave is generated in the ink filling the ink channel, a time duration T being required for the pressure wave to propagate one end to the other in a lengthwise direction of the ink channel; (b) stopping the application of the first pulse signal to the actuator at a second timing Tp after expiration the time duration T so that the volume of the ink chamber reverts to the natural volume, thereby ejecting an ink droplet from the nozzle, a duration of the first pulse signal being defined by a duration of time from the first timing To to the second timing Tp; (c) applying a second pulse signal to the actuator so that pressure fluctuations remaining in the ink are canceled out, the second pulse signal having a voltage level equal to the voltage level of the first pulse signal; and (d) stopping the application of the second pulse signal to the actuator at a fourth timing Te, a duration of the second pulse signal being defined by a duration of time from the third timing Ts to the fourth timing Te and differing from the duration of the first pulse signal, where a midpoint timing Tm between the third timing Ts and the fourth timing Te occurs after a duration of time longer than 3.20T but shorter than 3.75T from the first timing To.

The duration of the second pulse signal is in a range from 0.3T to 1.7T excluding 1.0T.

It is preferable that the midpoint timing Tm between the third timing Ts and the fourth timing Te occur after a duration of time longer than 3.3T but shorter than 3.6T from the first timing To. In this case, the duration of the second pulse signal is preferably 0.5T or 1.5T.

BRIEF DESCRIPTION OF THE DRAWINGS

The particular features and advantages of the invention as well as other objects will become more apparent from the following description taken in conjunction with the accompanying drawings, in which:

FIG. 1(*b*) is a plan view showing the conventional ink ejection device shown in FIG. 1(*a*);

FIGS. 12(*a*) and 12(*b*) are tables illustrating results of experiments when width of the second pulse signal and application timing are changed according to the first and second embodiments of the present invention, respectively.

DETAILED DESCRIPTION OF THE PREFERRED EMBODIMENTS

Preferred embodiments of the present invention will be described with reference to the accompanying drawings.

Figure 1:
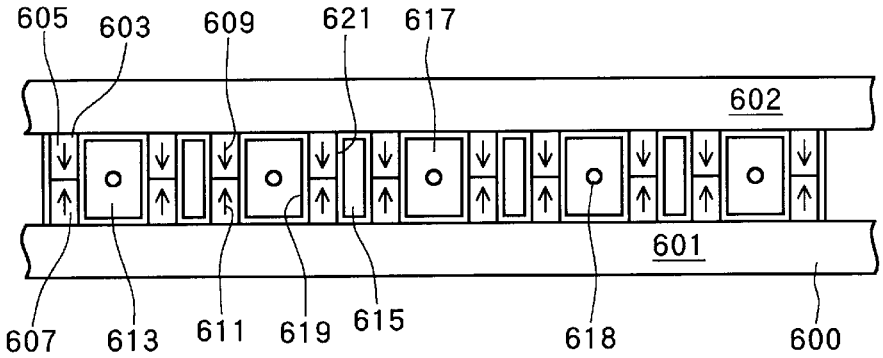
FIG. 1 (a) PRIOR ART
FIG. 1(*a*) is a cross-sectional view showing a conventional ink ejection device, to which the present invention is applied.
Figure 1:
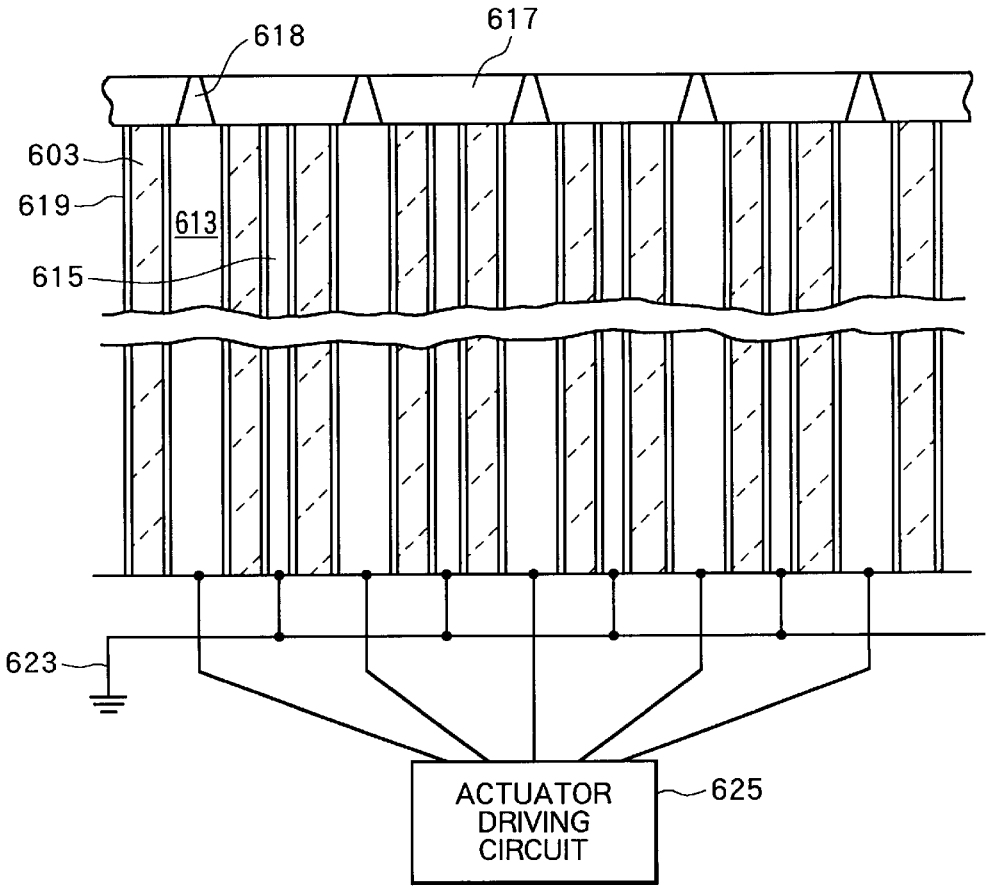
FIG. 1 (b) PRIOR ART
Figure 2:
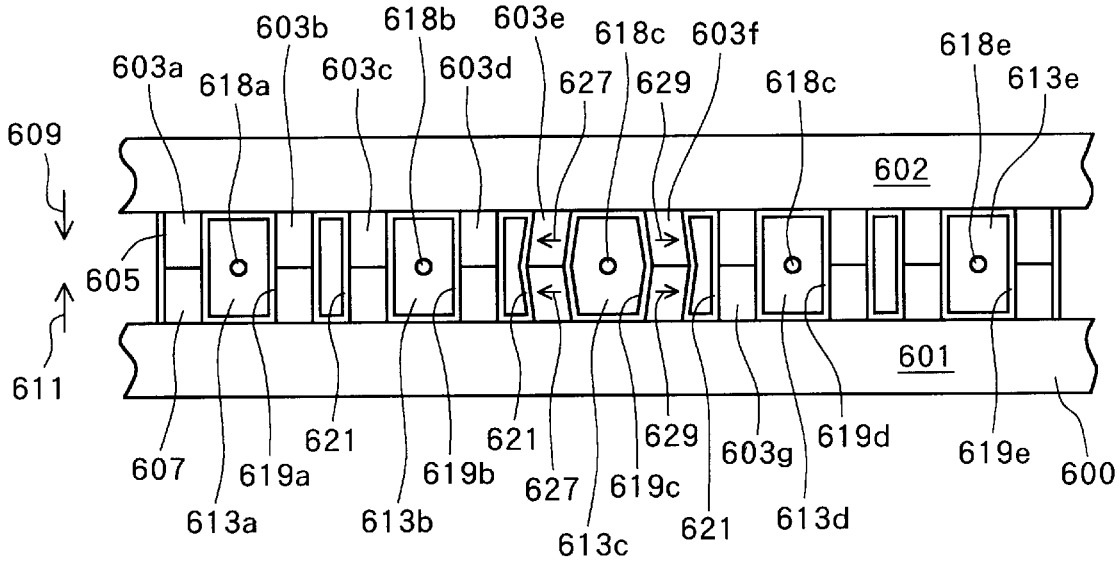
FIG. 2 PRIOR ART
FIG. 2 is a cross-sectional view illustrating an operation of the ink ejection device shown in FIGS. 1(*a*) and 1(*b*)
Figure 3:
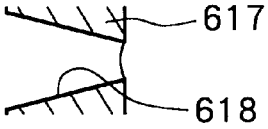
FIG. 3 (a) PRIOR ART
FIGS. 3(*a*) through 3(*g*) are cross-sectional views of ink nozzles illustrating an ink droplet forming process.
Figure 3:
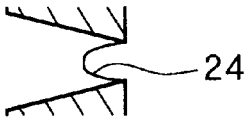
FIG. 3 (b) PRIOR ART
Figure 3:
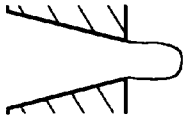
FIG. 3 (c) PRIOR ART
Figure 3:
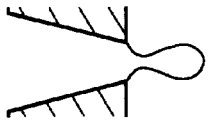
FIG. 3 (d) PRIOR ART
Figure 3:
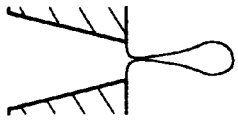
FIG. 3 (e) PRIOR ART
Figure 3:
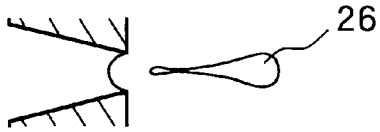
FIG. 3 (f) PRIOR ART
Figure 3:
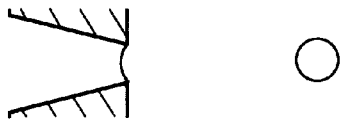
FIG. 3 (g) PRIOR ART
Figure 4:
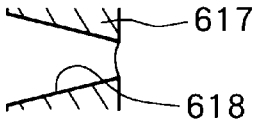
FIG. 4 (a) PRIOR ART
FIGS. 4(*a*) through 4(*h*) are cross-sectional views of ink nozzles illustrating an ink droplet forming process for forming a relatively voluminous ink droplet.
Figure 4:
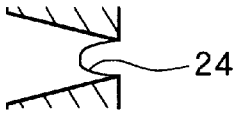
FIG. 4 (b) PRIOR ART
Figure 4:
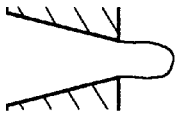
FIG. 4 (c) PRIOR ART
Figure 4:
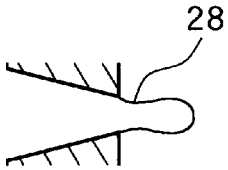
FIG. 4 (d) PRIOR ART
Figure 4:
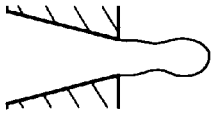
FIG. 4 (e) PRIOR ART
Figure 4:
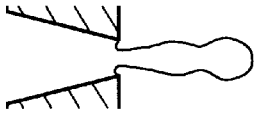
FIG. 4 (f) PRIOR ART
Figure 4:
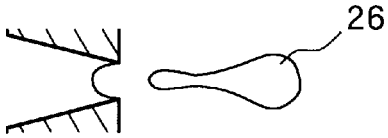
FIG. 4 (g) PRIOR ART
Figure 4:
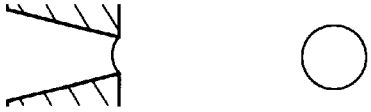
FIG. 4 (h) PRIOR ART
Figure 5:
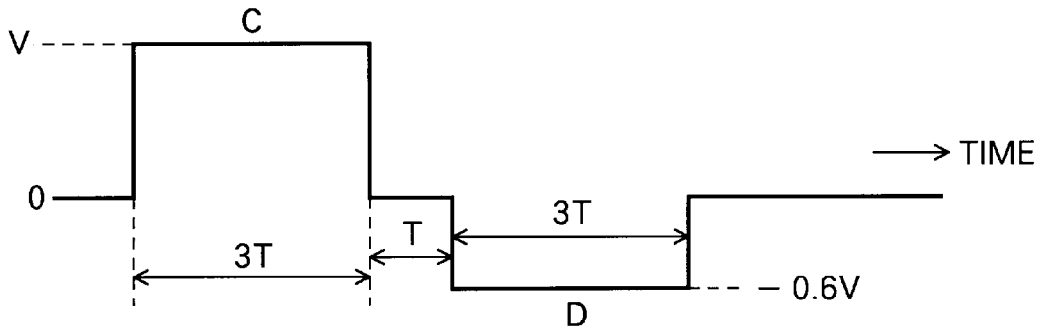
FIG. 5 (a) PRIOR ART
FIGS. 5(*a*) and 5(*b*) are diagrams illustrating voltage waveforms for driving the ink ejection devices according to prior arts.
Figure 5:
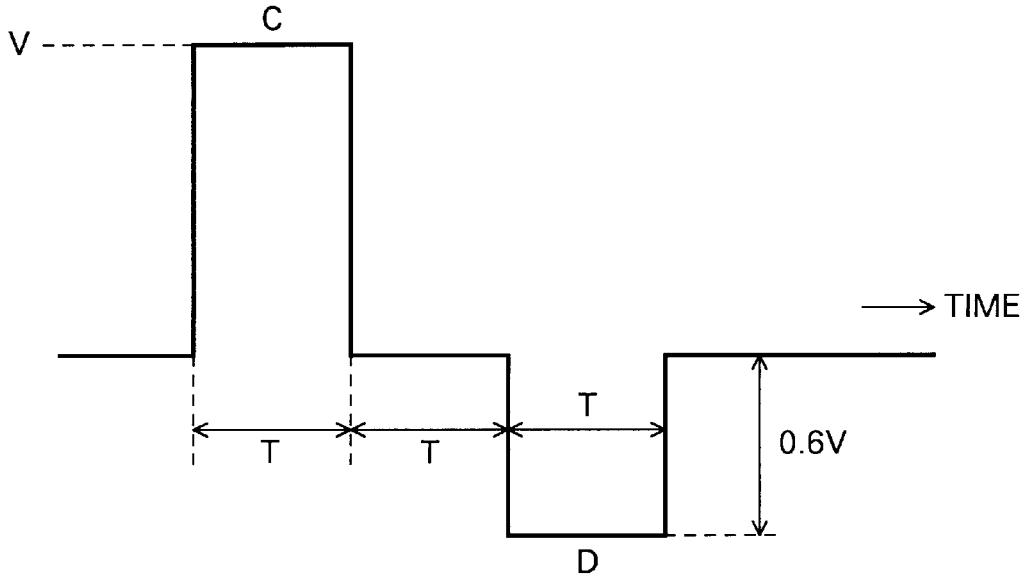
FIG. 5 (b) PRIOR ART
Figure 6:
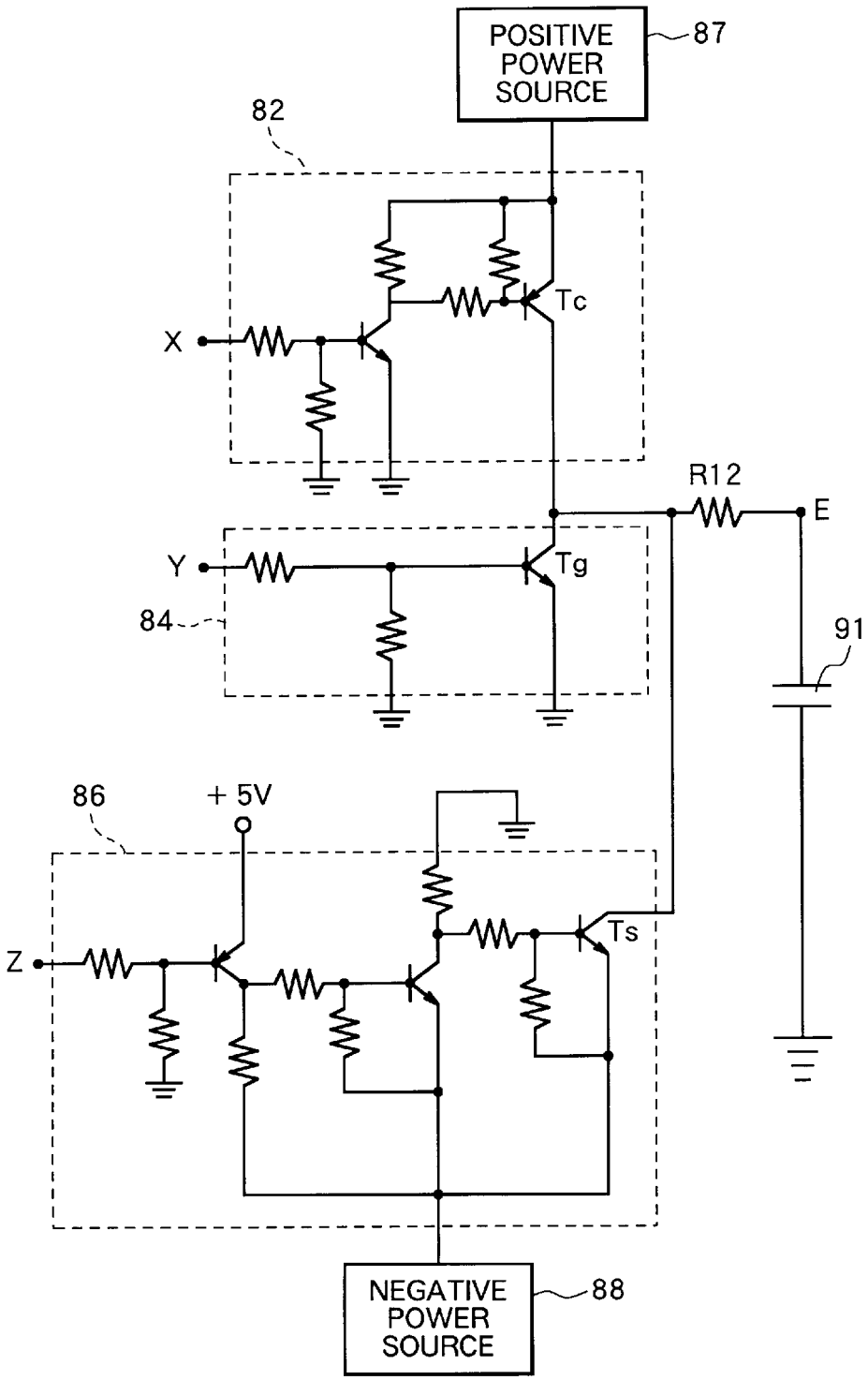
FIG. 6 PRIOR ART
FIG. 6 is a circuit diagram showing a driving circuit for generating the voltage waveforms shown in FIGS. 5(*a*) and 5(*b*)
Figure 7:
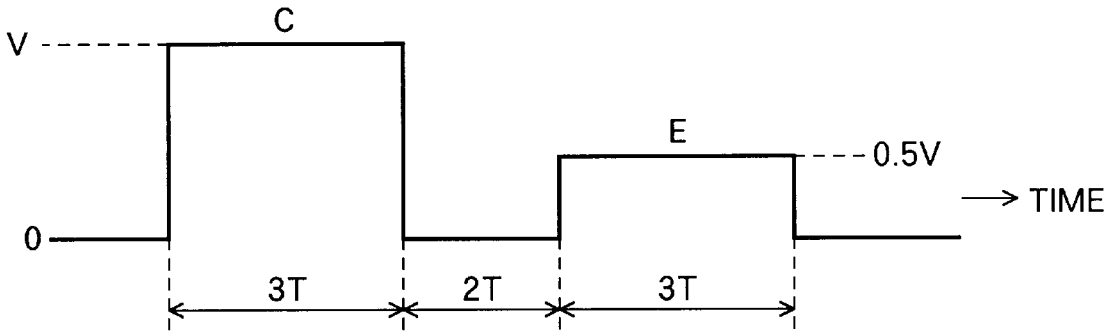
FIG. 7 (a) PRIOR ART
FIGS. 7(*a*) and 7(*b*) are diagrams illustrating another voltage waveforms for driving the ink ejection device according to prior arts.
Figure 7:
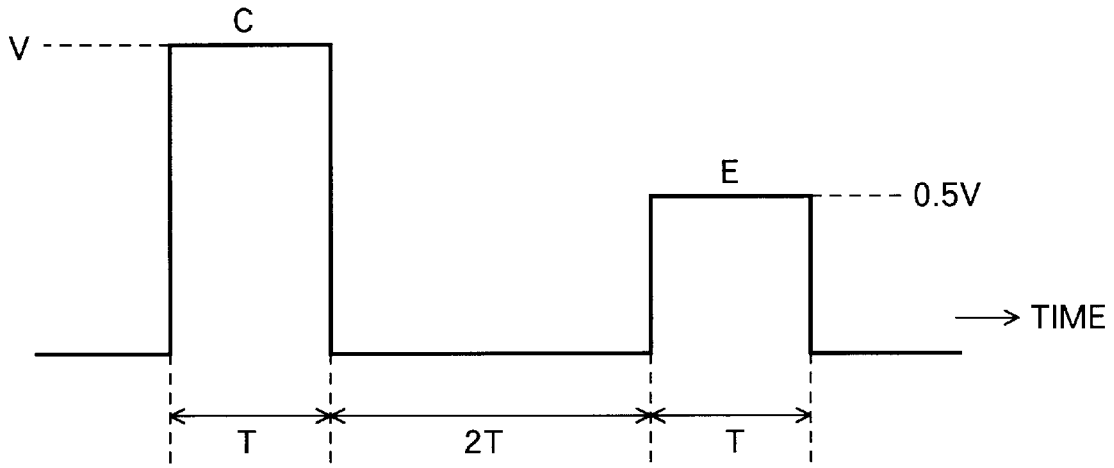
FIG. 7 (b) PRIOR ART
Figure 9:
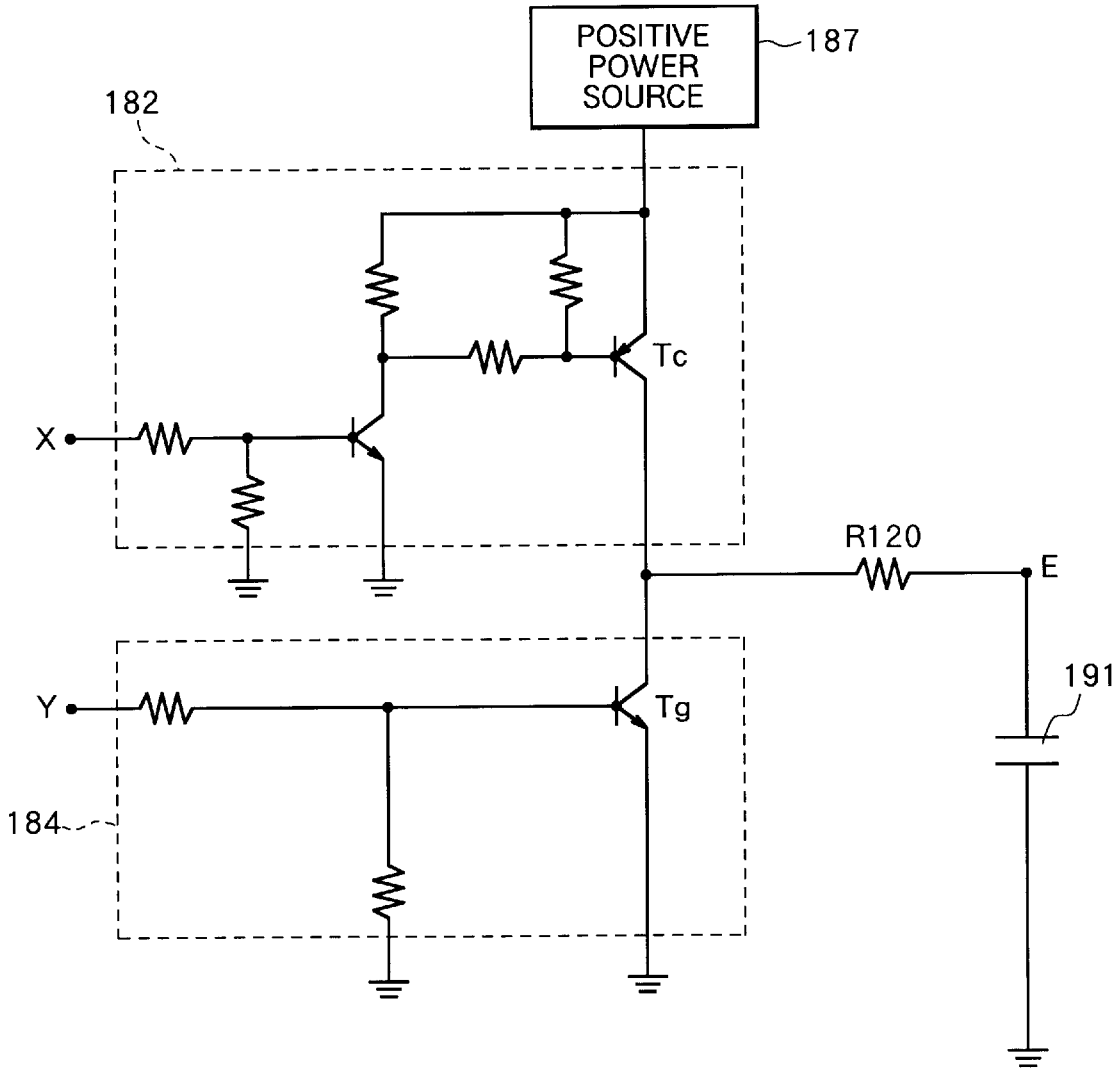
FIG. 9 is a circuit diagram showing a driving circuit for generating the voltage waveforms shown in FIGS. 8(*a*) and 8(*b*)

The present invention is applied to the ink ejection device 600 shown in FIGS. 1(*a*) and 1(*b*). Therefore, the description of the ink ejection device 600 will not be repeated here. A circuit arrangement of the actuator driving circuit 625 as used in the embodiment of the present invention is shown in FIG. 9 as will be described later in detail. Although not shown in the drawings, a microcomputer is connected to the actuator driving circuit 625 for applying input signals X and Y to the actuator driving circuit 625 in a prescribed sequential relation.

Dimensions of the ink ejection device according to the present embodiment will be described. The length L of the ink channel 613 is 7.5 mm. The diameter of the nozzle 618 on the outer side of the nozzle plate 617 is 40 $\mu$m, the diameter of the nozzle 618 on the inner side of the nozzle plate 617 is 72 $\mu$m, and the length of the nozzle is 100 $\mu$m. The ink used in the experiments is 2 mPa/s in viscosity, and 30 mN/m in surface tension. A ratio of the ink channel length L to the sound velocity a, i.e., L/a, is 8 $\mu$sec. The ratio L/a represents a time duration T required for a pressure wave generated in the ink filling the ink channel 613 to propagate one end to the other in a lengthwise direction of the ink channel.

In the following description, first and second embodiments will be described in parallel. The first embodiment will be described while referring to FIGS. 8(*a*), 9, 10(*a*), 11(*a*) and 12(*a*), and the second embodiment will be described while referring to FIGS. 8(*a*), 9, 10(*a*), 11(*a*) and 12(*a*), wherein FIG. 9 is common to both embodiments.

In both the first and second embodiments, two successively occurring pulse signals are to be applied to the electrode 619 of the ink channel 613 in a predetermined sequential relation. The first pulse signal is for ejecting an ink droplet from the nozzle 618 and the second pulse signal B is for canceling pressure variations remaining in the ink in the ink channel 613 after ejection.

Figure 8:
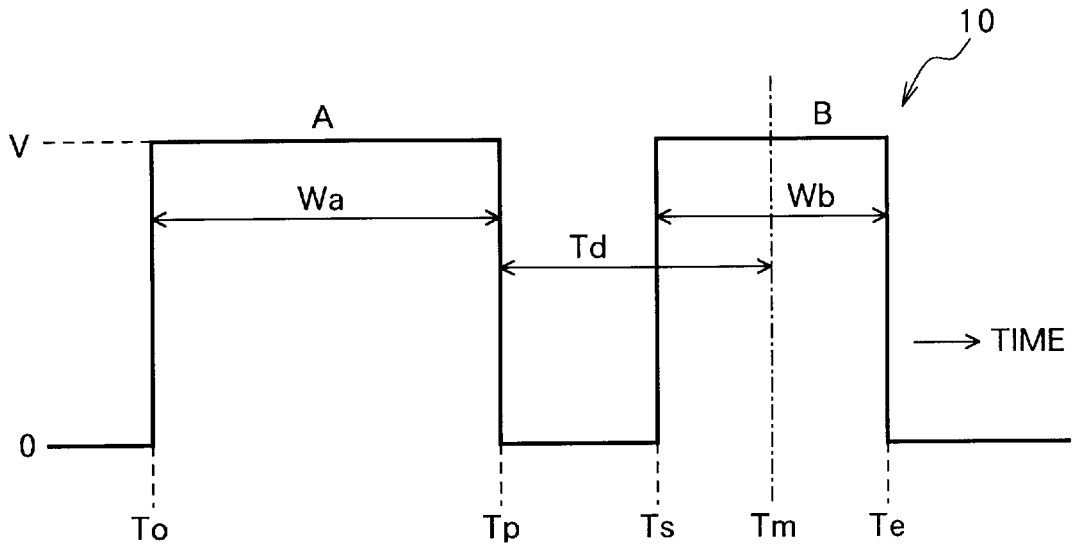
FIGS. 8(*a*) and 8(*b*) are diagrams illustrating voltage waveforms for driving the ink ejection device according to first and second embodiments of the present invention, respectively.
Figure 8:
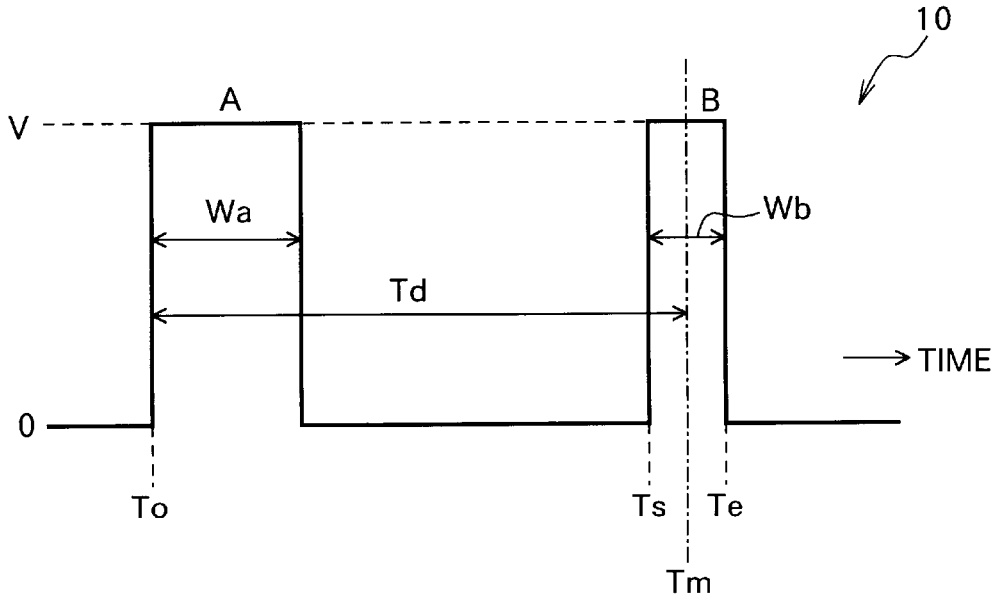

In the first embodiment, as shown in FIG. 8(*a*), one cycle of the pulse signals to be applied to the electrode 619 includes the first pulse signal A and the second pulse signal B. Both the first pulse signal A and the second pulse signal B have a crest value or a level of V volts (for example 22 volts). In the first embodiment, the first pulse signal A has a width or a duration Wa that is given by multiplying an odd number equal to or greater than three to the time duration T (=L/a). Shown in FIG. 8(*a*) is the duration Wa that is three times as long as the time duration T. That is, the duration Wa of the first pulse signal A is 24 μsec. The duration of the second pulse signal B is Wb that is 1.5 times as long as the time duration T, i.e., 12 μsec. Td represents the duration of time from the falling edge of the first pulse signal occurring at timing Tp to the midpoint timing Tm that is just a center between the rising edge of the second pulse signal B occurring at timing Ts and the falling edge thereof occurring at timing Te. The duration of time Td is 2.5 times as long as the time duration T, i.e., Td=20 μsec.

As shown in FIG. 8(*b*), the crest voltage levels V of the first pulse signal A and the second pulse signal B are also equal to each other in the second embodiment (for example, 20 volts). In the second embodiment, the first pulse signal A has a width or a duration Wa equal to the time duration T, i.e., 8 μsec. The duration Wb of the second pulse signal B is 0.5 times as long as the time duration T, i.e., 4 μsec. Unlike the first embodiment, Td in the second embodiment represents the duration of time from the rising edge of the first pulse signal occurring at timing To to the midpoint timing Tm that is just a center between the rising edge of the second pulse signal B occurring at timing Ts and the falling edge thereof occurring at timing Te. The duration of time Td is 3.5 times as long as the time duration T, i.e., Td=28 μsec.

The actuator driving circuit shown in FIG. 9 uses a single positive power source 187 and implements the production of the pulse signals shown in FIGS. 8(*a*) and 8(*b*) based on input signals X and Y.

The actuator driving circuit shown in FIG. 9 is formed from two blocks surrounded by broken lines. One block 182 indicates a charge circuit for charging a capacitor 191 and another block 184 indicates a discharge circuit for discharging charges in the capacitor 191.

Figure 10:
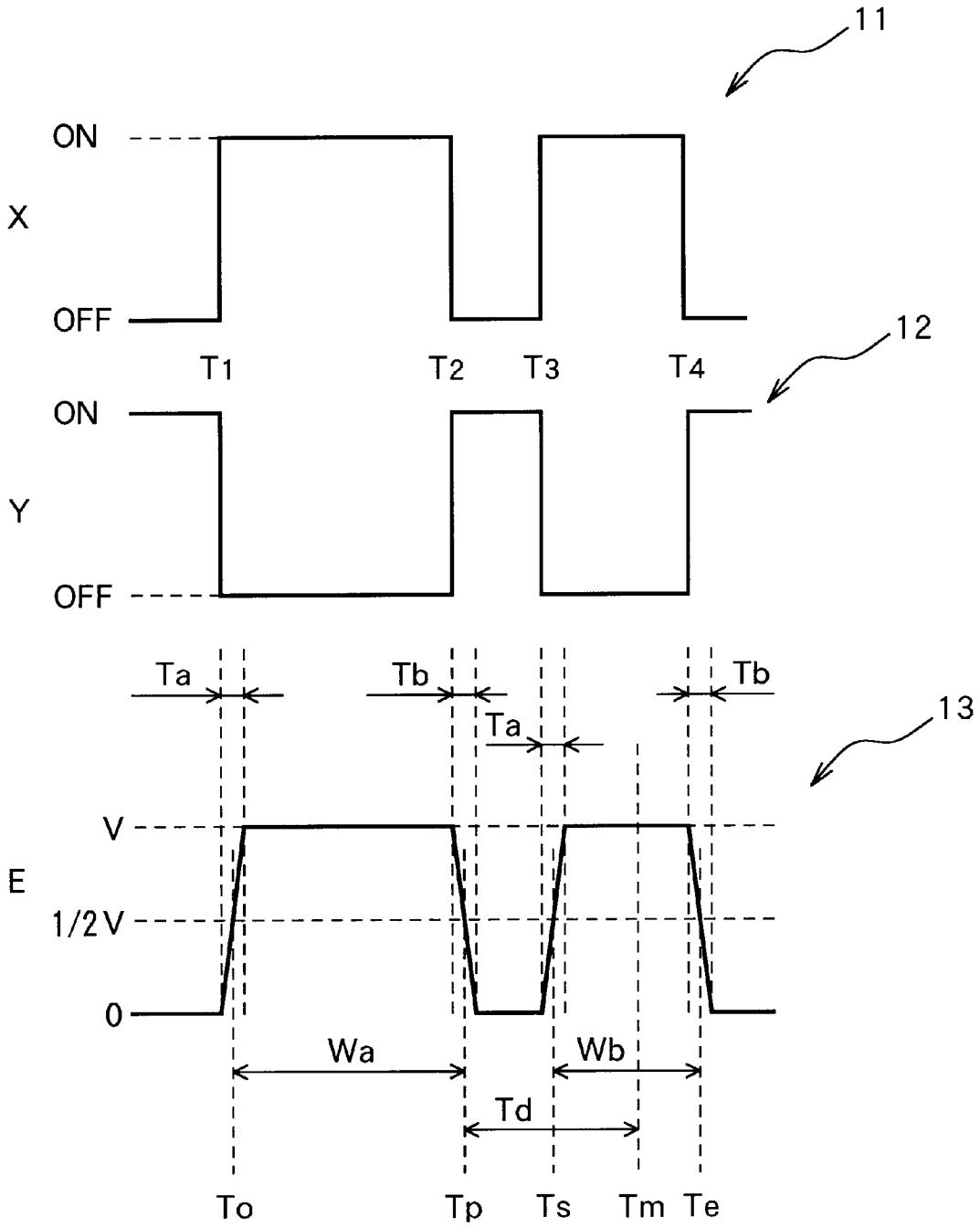
FIGS. 10(*a*) and 10*b*) are timing charts illustrating driving methods for the ink ejection device according to the first and second embodiments of the present invention, respectively.
Figure 10:
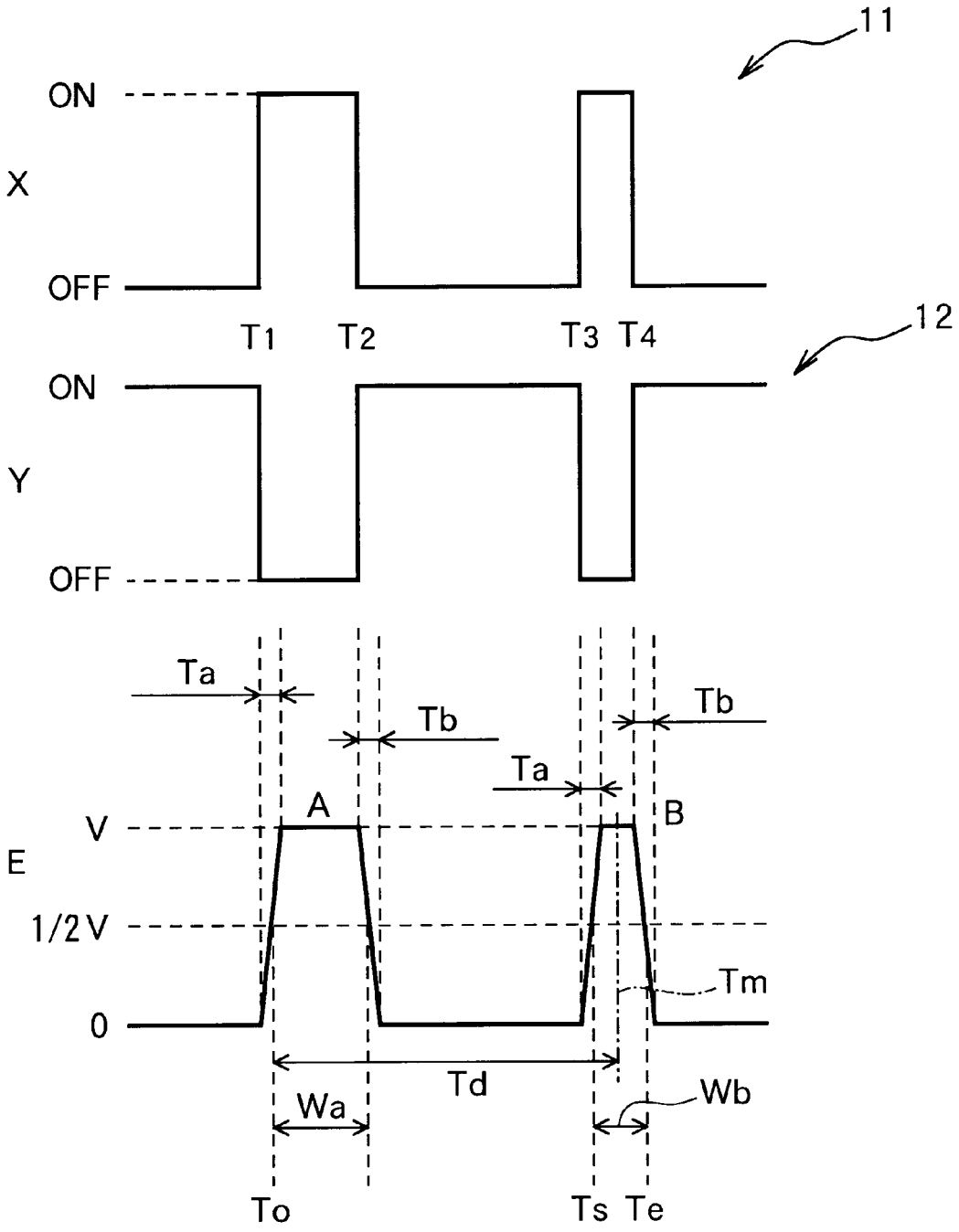

Operation of the driving circuit shown in FIG. 9 will be described while referring to the timing charts shown in FIGS. 10(*a*) and 10(*b*). FIG. 10(*a*) shows timing charts 11, 12 of the input signals X and Y respectively and the output voltage waveform 13 according to the first embodiment. FIG. 10(*b*) shows timing charts 11, 12 of the input signals X and Y respectively and the output voltage waveform according to the second embodiment.

As shown in FIGS. 10(*a*) and 10(*b*), the waveform of the two input signals X and Y are in a complementary relation, that is, the phase of the input signal X is in an inverse relation to the phase of the input signal Y. These input signals X and Y are supplied from the microcomputer.

As shown in the timing chart 11 of the input signal X, the input signal X is normally at a low level (OFF) and is rendered high (ON) at timing T1 and rendered low at timing T2. Thereafter, the input signal X is again rendered high at timing T3 and rendered low at timing T4.

A high level input signal X renders the transistor Tc conductive so that a positive voltage V from the positive power source 187 (22 volts in the case of the first embodiment and 20 volts in the case of the second embodiment) is applied to the electrode E of the capacitor 191 via a resistor R120. A high level input signal Y renders the transistor Tg conductive so that the electrode E of the capacitor 191 is grounded via the resistor R12. The capacitor 191 is formed by the electrodes 619 and 621 with the actuator wall 603 sandwiched therebetween.

The voltage applied to the electrode E (619) is normally at 0 volt but is raised to a voltage V (22 volts in the case of the first embodiment and 20 volts in the case of the second embodiment) after a charging duration Ta determined by the transistor Tc, the resistor R12 and the capacitor 191. Note that the capacitor 191 start charging at timing T1. At timing T2, the charges in the capacitor 191 are discharged so that the voltage applied to the electrode E turns to 0 volt after a discharging duration Tb determined by the transistor Tg, the resistor R12 and the capacitor 191. Subsequently, the capacitor 191 is charged at timing T3 so that the voltage applied to the electrode E is raised to the voltage V after the charging duration Ta. At timing T4, the charges in the capacitor 191 are discharged so that the voltage applied to the electrode E again turns to 0 volt after the discharging duration Tb.

As described, with the circuit shown in FIG. 9, a time interval Ta is needed for rising up the voltage from 0 volt to V volts and a time interval Tb is needed for falling down the voltage from V volts to 0 volt. Therefore, the duration Wa of the first pulse signal, the duration Wb of the second pulse signal, a delay time from the falling edge of the first pulse signal to the midpoint timing between the rising edge and the falling edge of the second pulse signal are determined based on the line where the voltage is V/2. The circuit is designed so that thus determined waveform is in coincidence with the waveform shown in FIG. 8(*a*). The same is true with respect to the pulse signal waveforms produced according to the second embodiment.

Figure 11:
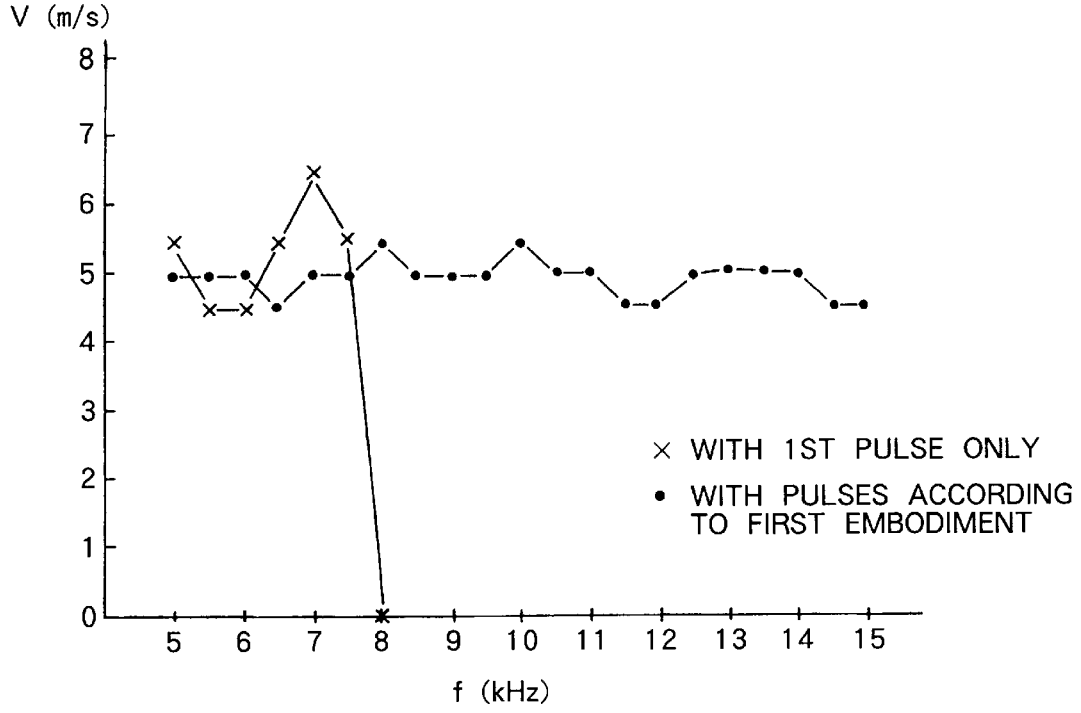
FIGS. 11(*a*) and 11(*b*) are graphical representations illustrating results of experiments when frequency of driving pulses are changed according to the first and second embodiments of the present invention, respectively.
Figure 11:
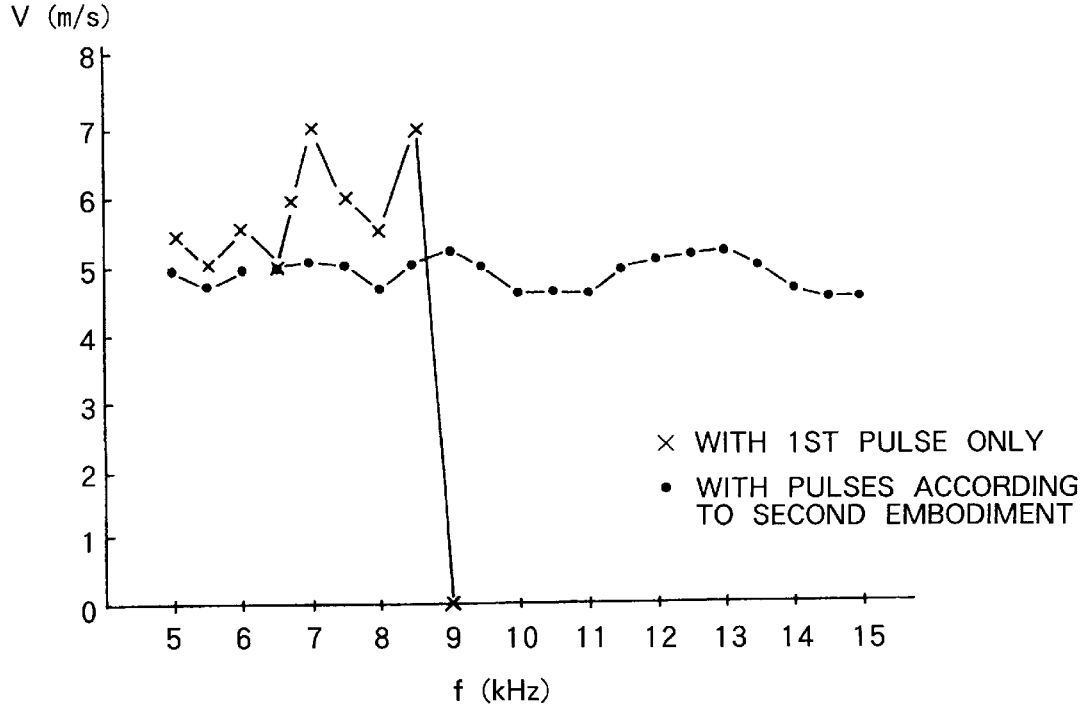

Ink ejection tests were performed with respect to the ink ejection device driven in accordance with the driving method of the first and second embodiments. In the first embodiment, the driving voltage is set to 22 volts. For this driving voltage, the ink ejection speed is 5 m/sec when the driving frequency is very low, e.g. 60 Hz. For the driving frequency from 5 kHz to 15 kHz, the ink could stably be ejected at an ink ejection speed ranging from 4.5 to 5.3 m/sec. To obtain comparative results, the ink ejection device was driven only with the first pulse signal A. In this case, the ink ejection speed varied in a range from 4.5 to 6.5 m/sec, and ink ejection was disabled when the driving frequency is above 8 kHz. Such tests results are shown in FIG. 11(*a*), from which it can be appreciated that the driving method of the first embodiment reduces the variation in the ink ejection speed when the frequency of the driving pulses is changed.

In the experimental test of the second embodiment, the driving voltage is set to 20 volts. For this driving voltage, the ink ejection speed is 5 m/sec when the driving frequency is very low, e.g. 60 Hz. For the driving frequency from 5 kHz to 15 kHz, the ink could also stably be ejected at an ink ejection speed ranging from 4.5 to 5.3 m/sec. To obtain comparative results, the ink ejection device was driven only with the first pulse signal A shown in FIG. 10(*b*). In this case, the ink ejection speed varied in a range from 5 to 7 m/sec, and ink ejection was disabled when the driving frequency is above 9 kHz. Such test results are shown in FIG. 11(*b*), from which it can be appreciated that the driving method of the first embodiment also reduces the variation in the ink ejection speed when the frequency of the driving pulses is changed.

Experimental tests were further performed to investigate optimal range of the width Wb of the second pulse B and the time delay Td. The time delay Td is defined by a time interval from the falling edge of the first pulse signal to the midpoint timing Tm of the second pulse signal in the first embodiment, and by a time interval from the rising edge of the first pulse signal to the midpoint timing Tm of the second pulse signal in the second embodiment.

FIG. 12(*a*) shows evaluation results for the first embodiment wherein the width Wb of the second pulse signal is changed from 0.3T to 2.0T and the delay time Td is changed from 2.0T to 3.0T. The evaluation is performed by observing the change of the ink ejection speed while changing the driving frequency from 5 kHz to 15 kHz. The driving voltage is set to 22 V so that the ink ejection speed becomes 5 m/sec when the driving voltage is at a frequency of 60 Hz.

In the evaluation of the first embodiment, the double-circle mark indicates that the variation of the speed is less than 1.0 m/sec; the single-circle mark, above 1.0 but less than 2.0 m/sec; the triangle mark, above 2.0 but less than 3 m/sec; and the cross mark indicates that the ink ejection is disabled at some frequency. From these results, it can be appreciated that the speed variation is small if the delay time Td is in the range from 2.25T to 2.75T and the width Wb of the second pulse signal is in the range from 0.3T to 2.0T. The speed variation of the ink droplet can further be reduced if the delay time Td is 2.5T or the width Wb of the second pulse signal B is in a range from 0.5T to 0.7T or from 1.3T to 1.7T, whereby ink ejection can be perform stably, and hence print quality is excellent.

FIG. 12(*b*) shows evaluation results for the second embodiment wherein the width Wb of the second pulse signal is changed from 0.3T to 2.0T and the delay time Td is changed from 3.1T to 3.9T. The evaluation is performed by observing the change of the ink ejection speed while changing the driving frequency from 5 kHz to 15 kHz. The driving voltage is set to 20 V so that the ink ejection speed becomes 5 m/sec when the driving voltage is at a frequency of 60 Hz.

From the results shown in FIG. 12(*b*), it can be appreciated that the speed variation is less than 2 m/sec when the delay time Td is in the range from 3.20T to 3.75 and the width Wb of the second pulse signal is in the range from 0.3T to 1.7T. In the latter range, 1.0T is excluded because when Wb=1.0T, an ink droplet is ejected. The speed variation of the ink droplet can further be reduced if the delay time Td is in a range from 3.3T to 3.6T and the width Wb of the second pulse signal B is 0.5T or 1.5T.

According to the present invention, the positive voltage V is applied as the first pulse signal to the electrode 619 of the ink channel 613, and subsequently the second pulse signal B having a positive voltage V same as the first pulse signal A is applied to the electrode 619 of the ink channel 613. As such, only positive power source suffices for operating the actuator driving circuit. In comparison with the cases in which the positive and negative power sources are used or two positive power sources supplying two different voltages are used as in the conventional ink ejection device, the driving circuit of the present invention can be simplified and hence the cost of manufacturing the control circuit can be reduced.

While two exemplary embodiments of this invention have been described in detail, those skilled in the art will recognize that there are many possible modifications and variations which may be made in these exemplary embodiments while yet retaining many of the novel features and advantages of the invention. For example, although the positive power source is used in the above described embodiments, a negative power source can be used if the polarization direction of the piezoelectric element is inverted with respect to the direction shown in FIG. 1(*a*).

Further, although in the above embodiments, the volume of the ink channel 613 is changed by deforming both the lower wall 607 and the upper wall 605 of the actuator wall 603, either the upper wall or the lower wall may be formed from a material which is free from piezoelectric deformation. In addition, spaces 615 provided at both sides of the ink channel 613 can be dispensed with and the ink channels may be positioned adjacent to each other.

What is claimed is:

1. A method of driving an ink ejection device having walls, a nozzle plate, an actuator and control means, the walls defining an ink channel, the ink channel having a volume filled with ink and having a length defined by two ends, the nozzle plate attached to one end of the ink channel and formed with a nozzle, the actuator operable for changing the volume of the ink channel, and the control means, operable in association with a single power source, for applying pulse signals to the actuator, the method comprising the steps of:

(a) applying a first pulse signal to the actuator at a first timing To so that the volume of the ink channel is increased from a natural volume to an increased volume, the first ink channel, a time duration T being required for the pressure wave to propagate from one end to the other end in a lengthwise direction of the ink channel;

(b) stopping the application of the first pulse signal to the actuator at a second timing Tp after expiration of a predetermined duration of time given by multiplying an odd number equal to or greater than three to the time duration T so that the volume of the ink chamber reverts to the natural volume, thereby ejecting an ink droplet from the nozzle, a duration of the first pulse signal being defined by a duration of time from the first timing To to the second timing Tp;

(c) applying a second pulse signal to the actuator at a third timing Ts so that pressure fluctuations remaining in the ink are canceled out, the second pulse signal having a voltage level equal to the voltage level of the first pulse signal; and (d) stopping the application of the second pulse signal to the actuator at a fourth timing Te, a duration of the second pulse signal being defined by a duration of time from the third timing Ts to the fourth timing Te and differing from the duration of the first pulse signal, wherein a midpoint timing Tm between the third timing Ts and the fourth timing Te occurs after 2.25T to 2.75T from the second timing Tp.

2. A method according to claim 1, wherein the duration of the second pulse signal is in a range from 0.3T to 2.0T.

3. A method according to claim 2, wherein the duration of the second pulse signal is preferably in a range from 0.5T to 0.7T.

4. A method according to claim 2, wherein the duration of the second pulse signal is preferably in a range from 1.3T to 1.7T.

5. A method according to claim 4, wherein the duration of the second pulse signal is more preferably 1.5T.

6. A method according to claim 1, wherein the midpoint timing Tm occurs after 2.5T from the second timing Tp.

7. A method according to claim 2, wherein steps (a) through (d) are executable at a frequency ranging from 5 kHz to 15 kHz.

8. A method according to claim 1, wherein the actuator is in the form of a wall defining the ink channel, at least a portion of the actuator being formed from a piezoelectric material.

9. A method of driving an ink ejection device having walls, a nozzle plate, an actuator and control means, the walls defining an ink channel, the ink channel having a volume filled with ink and having a length defined by two ends, the nozzle plate attached to one end of the ink channel and formed with a nozzle, the actuator operable for changing the volume of the ink channel and the control means, operable in association with a single power source, for applying pulse signals to the actuator, the method comprising the steps of:

(a) applying a first pulse signal to the actuator at a first timing To so that the volume of the ink channel is increased from a natural volume to an increased volume, the first pulse signal having a voltage level, wherein a pressure wave is generated in the ink filing the ink channel, a time duration T being required for the pressure wave to propagate from one end to the other end in a lengthwise direction of the ink channel;

(b) stopping the application of the first pulse signal to the actuator at a second timing Tp after expiration the time duration T so that the volume of the ink chamber reverts to the natural volume, thereby ejecting an ink droplet from the nozzle, a duration of the first pulse signal being defined by a duration of time from the first timing To to the second timing Tp;

(c) applying a second pulse signal to the actuator so that pressure fluctuations remaining in the ink are canceled out, the second pulse signal having a voltage level equal to the voltage level of the first pulse signal; and (d) stopping the application of the second pulse signal to the actuator at a fourth timing Te, a duration of the second pulse signal being defined by a duration of time from the third timing Ts to the fourth timing Te and differing from the duration of the first pulse signal, wherein a midpoint timing Tm between the third timing Ts and the fourth timing Te occurs after a duration of time longer than 3.20T but shorter than 3.75T from the first timing To.

10. A method according to claim 9, wherein the duration of the second pulse signal is in a range from 0.3T to 1.7T excluding 1.0T.

11. A method according to claim 9, wherein the midpoint timing Tm between the third timing Ts and the fourth timing Te occurs after a duration of time longer than 3.3T but shorter than 3.6T from the first timing To.

12. A method according to claim 11, wherein the duration of the second pulse signal is 0.5T.

13. A method according to claim 11, wherein the duration of the second pulse signal is preferably 1.5T.

14. A method according to claim 10, wherein steps (a) through (d) are executable at a frequency ranging from 5 kHz to 15 kHz.

15. A method according to claim 9, wherein the actuator is in the form of a wall defining the ink channel, at least a portion of the actuator being formed from a piezoelectric material.

* * * * *